United States Patent [19]

Yoshida et al.

[11] Patent Number: 5,060,022

[45] Date of Patent: Oct. 22, 1991

[54] IMAGE PROCESSING EQUIPMENT FOR SETTING IMAGE DENSITY CONDITIONS ACCORDING TO TEMPERATURE

[75] Inventors: Takeshi Yoshida; Nariaki Tanaka, both of Osaka, Japan

[73] Assignee: Mita Industrial Co., Ltd., Osaka, Japan

[21] Appl. No.: 553,752

[22] Filed: Jul. 13, 1990

[30] Foreign Application Priority Data

Jul. 18, 1989 [JP] Japan ..... 1-185802
Jul. 18, 1989 [JP] Japan ..... 1-185803

[51] Int. Cl.[5] ..... G03G 21/00

[52] U.S. Cl. ..... 355/246; 355/30; 355/208

[58] Field of Search ..... 355/208, 211, 214, 200, 355/246, 30, 308; 219/216

[56] References Cited

U.S. PATENT DOCUMENTS

| | | | |
|---|---|---|---|
| 4,136,945 | 1/1979 | Stephens | 355/208 |
| 4,468,110 | 8/1984 | Tanigawa et al. | 355/268 |
| 4,502,777 | 3/1985 | Okamoto et al. | 355/208 |
| 4,508,446 | 4/1985 | Imai | 355/208 |
| 4,797,707 | 1/1989 | Iwahashi et al. | 355/208 |

*Primary Examiner*—A. T. Grimley
*Assistant Examiner*—Robert Beatty
*Attorney, Agent, or Firm*—Koda and Androlia

[57] ABSTRACT

Image processing equipment featuring that image forming processing is conducted by selectively applying image density setting conditions according to the temperature of a photo-sensitive body when characteristic deterioration exceeding an appointed level is detected by detecting irreversible characteristic deterioration of the photosensitive body.

3 Claims, 5 Drawing Sheets

(a)

(b)

IMAGE PROCESSING EQUIPMENT FOR SETTING IMAGE DENSITY CONDITIONS ACCORDING TO TEMPERATURE

BACKGROUND OF THE INVENTION

1. Field of the invention

This invention relates to an improvement of an image processing equipment of a copying machine or a printer for instance, by which the image density setting conditions can be adjusted according to the temperature change of a photosensitive body and more particularly relates to an image processing equipment by which a beautiful image density can be secured at all times by selectively determining proper image density setting conditions even in the case that such an irreversible characteristic deterioration of a photosensitive body as electrification power, sensitivity, etc. occurs.

2. Description of the Prior Art

There are some of photosensitive bodies utilized in an image processing equipment, of which such an characteristic as electrification power, etc. may change according to the temperature. For this reason, a copying equipment in which the characteristic changes accompanied with the temperature change of a photosensitive body can be detected by accumulatively calculating the copy processing time to cause such image density setting conditions as voltage, etc. given to an exposure lamp to be changed has been already known to those skilled in the art (refer to, for instance, the Japanese Laid-open Pat. Pub. No. Sho-63-191161).

In such a conventional art, as the image density setting conditions are changed according to the changes of the characteristic due to the temperature changes of the photosensitive body, it is excellent in the point of securing a constant image density, not depending upon the temperature changes of the photosensitive body.

Thus, in a copying equipment disclosed by the Japanese Laid-Open Pat. Pub. Sho-63-191161, the image density is kept constant by, for instance, lowering (increasing) the voltage of an exposure lamp according to increase (or decrease) of the temperature of a photosensitive body. Therefore, such a control method as shown in the above can correspond to so-called reversible changes i.e., the characteristic of the photosensitive body returns to the original state thereof as the temperature of the photosensitive body returns as before. However, it can not correspond to the case that the characteristic of the photosensitive body changes irreversibly.

Such irreversible changes of the characteristic for the temperature of the photosensitive body as shown in the above are remarkable in the case of an organic photosensitive body. For instance, even though the temperature returns to the original level thereof if the organic photosensitive body is intermittently or consecutively exposed to a temperature exceeding 50° C. for more than an appointed period of time, it is known that the relationship between the temperature and the characteristic does not return as before, i.e., it shows irreversible changes.

And in the case that the relationship between the temperature and the characteristics of a photosensitive body changes irreversibly as shown in the above, letting the image density setting conditions strictly follow accompanies complication of softwares and large scale of the capacity of a memory device in the present time when such a technology as to carry out universal control by applying a micro computer has been developed, and it necessarily results in increase of the production cost.

SUMMARY OF THE INVENTION

It is therefore a primary object of the invention to provide an image processing equipment by which a constant image density can be secured for a longer period of time by changing the image density setting conditions, following up irreversible changes of the relationship between the temperature and the characteristic of a photosensitive body.

It is a secondary object of the invention not to result in increase of the production cost to a large scale by making as a simplified control as possible together with strictly following up the changes as much as possible in the case that a photosensitive body changes irreversibly.

In order to achieve the objects, the first invention is an image processing equipment which can detect irreversible characteristic deterioration of a photosensitive body and change the relation of the image density conditions for the temperature of a photosensitive body according to the irreversible characteristic deterioration in an image density adjusting method of the image processing equipment so composed as to adjust the image density setting conditions to the temperature changes of the photosensitive body.

Also, the second invention is an image processing equipment so composed as to adjust the image density setting conditions to the temperature changes of a photosensitive body and furnished with means for detecting irreversible characteristic deterioration of a photosensitive body and means for changing the relation of the image density conditions for the temperature of the photosensitive body according to the irreversible characteristic deterioration.

It is possible to detect irreversible characteristic deterioration of a photosensitive body, for instance, by the period of time of accumulation by accumulatively calculating the period of time during which the temperature of the photosensitive body is over an appointed level.

Thus, as deterioration of the photosensitive body is detected by the deterioration detecting means, the relationship between the temperature of the photosensitive body and the image density conditions which have suited to reversible changes up to now will not be able to be applied. Instead, the relationship between the temperature of a photosensitive body and the image density condition which suits to irreversible changes will be applied.

In order to accomplish the above objects, the third invention is an image processing equipment so composed as to adjust the image density setting conditions according to the temperature changes of a photosensitive body and comprising deterioration detecting means for detecting the irreversible characteristic deterioration of the photosensitive body, temperature detecting means for detecting the temperature of the photosensitive body, condition memorizing means for memorizing the escalation of image density setting conditions according to the temperature of the photosensitive body, and control means for carrying out image processing and forming by selectively applying the image density setting conditions memorized in the condition memorizing means according to the temperature of the photosensitive body detected by the temperature detecting means when the photosensitive body characteristic deterioration exceeding an appointed level is detected by the deterioration detecting means.

As the deterioration of a photosensitive body is thus detected by the deterioration detecting means, the image density setting condition best suited to the temperature of the photosensitive body at this time is selected and is adopted to the image processing and forming, thereby causing proper image density setting conditions to be selectively adopted according to the temperature of the photosensitive body. As the escalation of image density setting conditions are memorized according to the temperature of the photosensitive body, any large-scaled memory capacity is not needed and the control method can be also simplified.

DETAILED DESCRIPTION OF THE PREFERRED EMBODIMENTS

While only certain embodiments of the present invention have been described, it will be apparent to those skilled in the art that various changes and modifications may be made therein without departing from the spirit and scope of the present invention as claimed.

Figure 1:
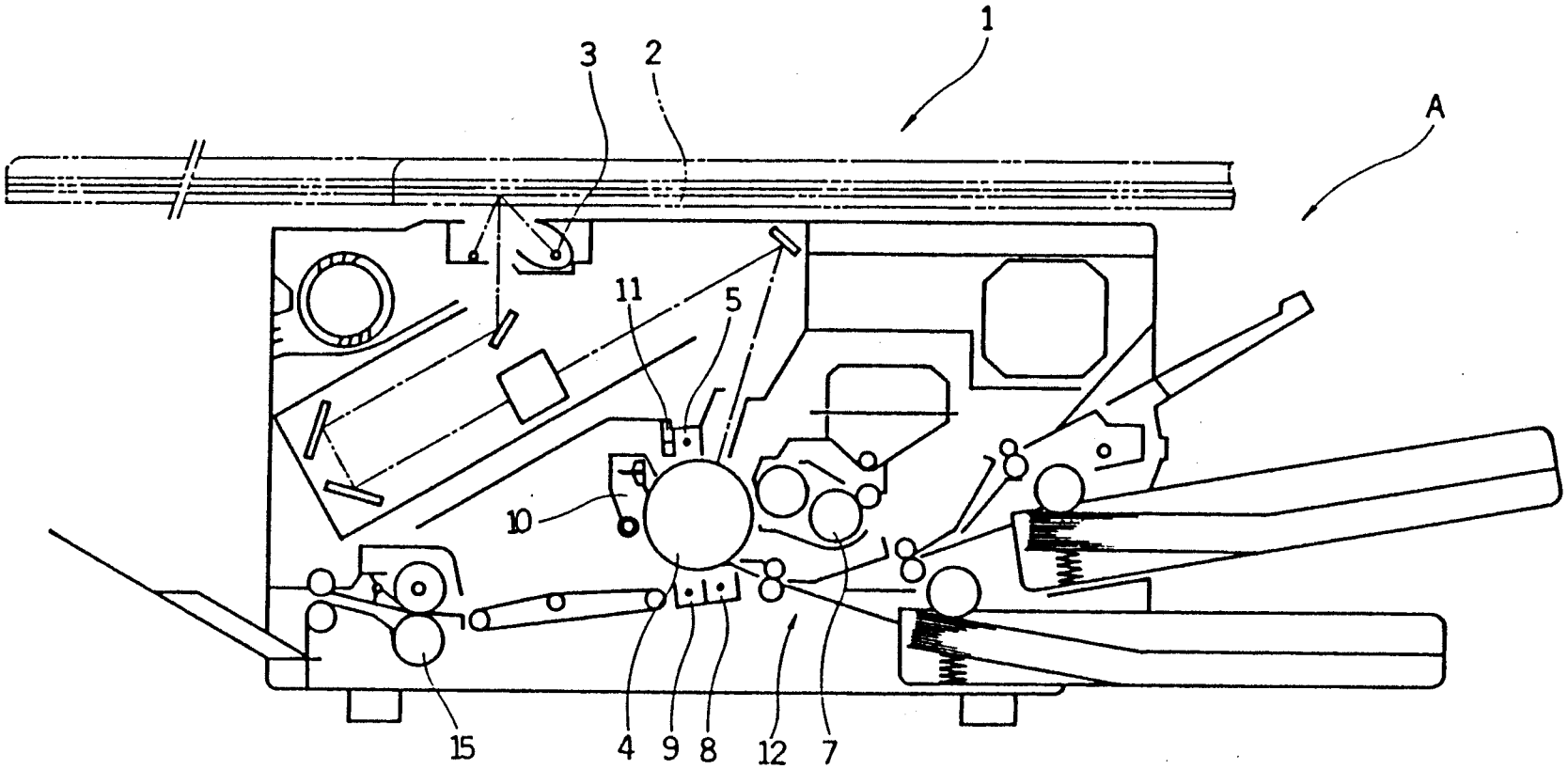
FIG. 1 is a roughly front sectional view showing the whole structure of an image processing equipment according to one of the preferred embodiments of the invention.

As shown in FIG. 1, the image processing equipment according to this embodiment has an exposure lamp 3 by which a document 2 set on a document table 1 is exposed to light and scanned in accordance with movement of the document table 1. A main charger 5, a developing unit 7, a transferring charger 8, a separating charger 9, a cleaner 10 and a thermister 11 for measuring the ambient temperature of the photosensitive body drum 4 are arranged in this order in the vicinity of an organic photosensitive drum (photosensitive body) 4 which is rotatably attached to the underside of the document table 1. The thermister constitutes one of the examples of the temperature detecting means.

Therefore, a copying paper which passes through the transferring paper transfer portion 12 and is led to the transferring portion between the photosensitive body drum 4 and the transferring charger 8 is peeled off from the photosensitive body drum 4 by means of the separating charger 9 after the toner image is transferred and is led to a fixing unit 15.

Also, the image processing equipment "A" according to this embodiment is such a type that the document table 1 can move to expose a document 1 to a lamp for scanning. However, the invention can be also applied to such a type that the exposure lamp 3 can move for light exposure and scanning.

In the ensuing description, the explanation is made, taking for instance the AVR output voltage (the driving voltage for the exposure lamp 3) given to the exposure lamp 3 as the image density setting condition. However, this is only one of the examples. For example, a charging voltage give to the main charger 5 may be selected as the image density setting condition, and a bias voltage given to the developing sleeve of the developing unit 7 may be also selected as the image density setting condition.

Figure 2:
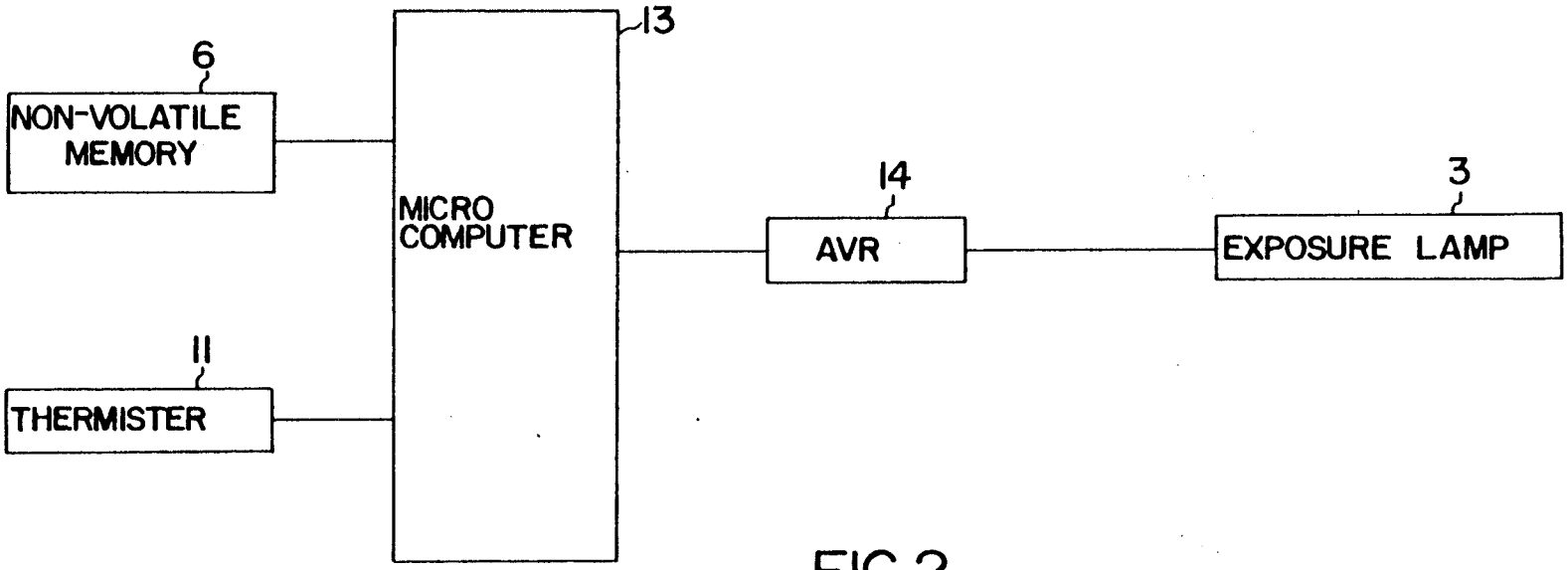
FIG. 2 is a block diagram showing the outline of control of the image processing equipment.

FIG. 2 is a block diagram showing the signal system of the drive adjusting unit of the exposure lamp 3. Signals from the thermister 11 which can detect the surface temperature of the photosensitive body drum 4 from the ambient temperature are supplied to a micro computer 13 through an A/D converter and an I/0 interface, which are not illustrated herein. A non-volatile memory 6 is connected to the micro computer 13. The non-volatile memory 6 is for memorizing the values of a counter described later to express the degree of the irreversible characteristic deterioration of the photosensitive body drum 4.

Also an AVR 14 which drives the exposure lamp 3 at a constant voltage through an I/O interface and an A/D converter, which are not illustrated herein, is connected to the output side of the micro computer 13.

Next, prior to explaining the control procedure of the image processing equipment "A", the pattern of changes of the image density setting conditions (voltage given to the exposure lamp 3=AVR output voltage) for the temperature of the photosensitive body is explained with reference to FIG. 3. The vertical axis of FIG. 3 expresses the amount of compensation V(t) for instance in the case that the AVR output voltage of 85 volts is given under the normal temperature condition (20° C.).

Usually, in the case of an organic photosensitive body, it is so controlled that the drive voltage (AVR output voltage) can be decreased since the sensitivity is increased as the temperature rises and the AVR output voltage can be increased as the sensitivity is lowered as the temperature goes down. However, the example shown in FIG. 3 shows that the sensitivity is not changed and becomes constant as the surface temperature of the photosensitive body drum 4 exceeds 40° C.

Namely, the value shown with the solid line is the amount of compensation V(t) of AVR output voltage, and it means that the compensation is so controlled that for instance the AVR output voltage can be decreased by 6.0 V (85−6.0=79.0 V) when the surface temperature is 40° C., the AVR output voltage can be increased by 3.5 V (85+3.5 =88.5 V) when the drum temperature T is 8° C., and 85 V can be given when the surface temperature is 20° C. However, this is applicable only under such a state that any irreversible characteristic deterioration does not occur in the photosensitive body.

Figure 3:
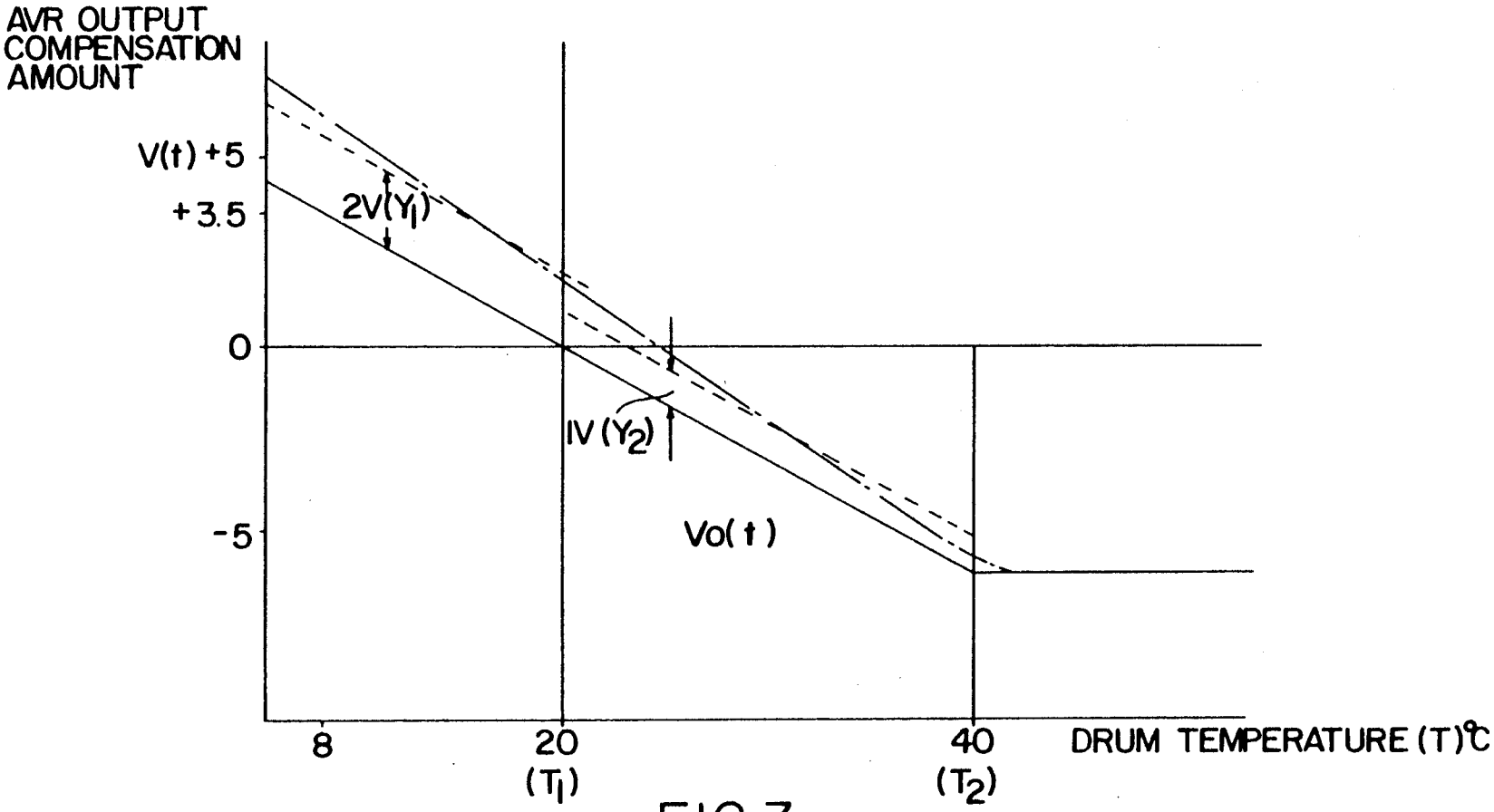
FIG. 3 is a graph showing the relationship of compensation of the charge voltage, which is one of the image density setting conditions, for the temperature of a photo-sensitive body drum, and FIG. 4 (*a*) and (*b*) are flow charts showing the control procedure of the image processing equipment respectively.

To the contrary, in the case that an appointed degree of irreversible characteristic deterioration occurs in the photosensitive body drum 4, strictly the amount of compensation V(t) of the AVR output voltage must be changed as shown with the one-dashed line in FIG. 3.

But, if the AVR output voltage is intended to be strictly compensated according to the temperature changes of the photosensitive body drum 4, the control method will be complicated and larger memory capacity will be needed. Therefore, in the embodiment, the AVR output compensation amount V(t) is escalationally changed when the temperature of the photosensitive body drum 4 is around 20° C. and around 40° C., thereby causing the control to be simplified.

Namely, as shown with the dashed line in FIG. 3, when the drum temperature T is less than 20° C., the AVR output compensation amount V(t) shall be the compensation amount +2 V (constant) under the condition that there is no irreversible characteristic deterioration. When the drum temperature T is from 20° C. to 40° C., the compensation amount V(t) shall be the compensation amount +1 V (constant) under the condition that there is no irreversible characteristic deterioration, and when the drum temperature T is more than 40° C., the compensation amount shall be set to the same AVR output compensation amount as that under the condition that there is no irreversible characteristic deterioration.

According to the invention, the compensation amount may be modified as shown with the one-dashed line in FIG. 3 as described in the above, or may be modified as shown with the dashed lines. The feature of the invention exists in such a point that the conditions can be changed as shown in the above.

Consecutively, the setting procedure of the AVR output compensation amount V(t) is explained with reference to FIG. 4.

Figure 4:
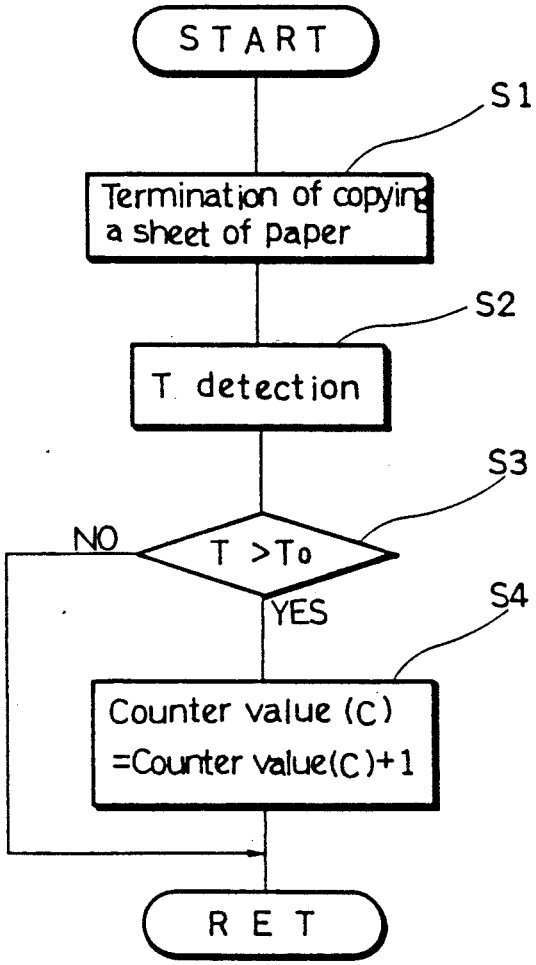
Figure 4:
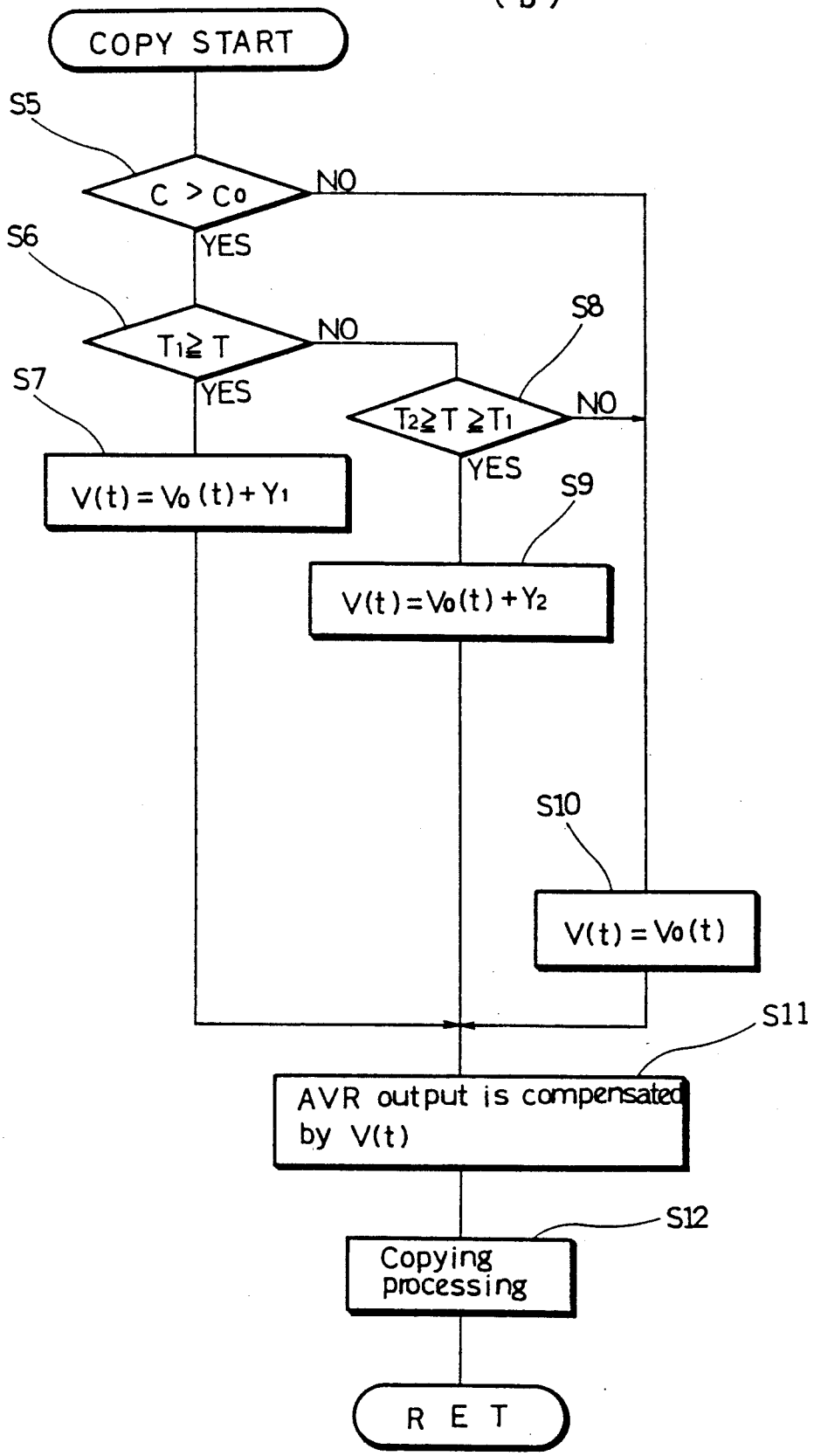

FIG. 4 (*a*) shows the processing at the point when copying a sheet of paper is terminated, and FIG. 4 (*b*) shows the processing prior to copying a sheet of paper.

S1, S2, . . . in the ensuing description show the number of the processing procedures (steps). As shown in the step S1 in FIG. 4 (*a*), as copying a sheet of paper is terminated, the surface temperature T of the photosensitive body drum 4 can be detected (in the step S2) by the output signals from the thermister 11. In the case that this drum temperature T is higher than an appointed temperature level To (in the step S3), the value C of the counter composed of the non-volatile memory 6 is incrementally increased by 1. Also, the value of the counter is reset when installing a copying machine or replacing the photosensitive body drum 4.

The appointed temperature To is such a high temperature that if the photosensitive body drum 4 is exposed to the appointed temperature for a longer period of time the irreversible characteristic deterioration can occur. In the above description, the appointed temperature is explained for instance as 50° C. Therefore, in the case that the drum temperature T is lower than the appointed temperature level To in the step S3, the value of the counter is not incrementally increased.

As the procedure shown in FIG. 4 (a) is repeated whenever copying a sheet of paper is terminated, the number of times of the copying processing which has been carried out over the appointed limit temperature To is stored in the non-volatile memory 6.

On the other hand, as copying processing is started by pushing the start button, the value C of the counter stored in the non-volatile memory 6 is compared with the appointed limit number Co of times as shown in the step S5 in FIG. 4. Here, in the case that it is judged that the value C of the counter exceeds the appointed limit number Co of times, it is judged that irreversible characteristic deterioration has occurred in the photosensitive drum 4, thereby causing the processing in the following steps S6 through S9 to be conducted. Therefore, means for realizing the function for judging the value C of the counter is one of the examples of the deterioration detecting means.

Namely, in the case that the value of the counter exceeds the limit number of times Co, it is then judged whether or not the surface temperature T of the photosensitive body drum 4 is lower than an appointed partitioning temperature $T_1$. This partitioning temperature is expressed with, for instance, 20° C. in FIG. 3. When the drum temperature T is lower than $T_1$ (20° C.), the AVR output compensation amount V(t) is expressed with Vo (t)+$Y_1$. Here, Vo (t) is the AVR output compensation amount in the case that any irreversible characteristic deterioration is not yielded, and for instance, in the example shown in FIG. 3, the Vo is the value which changes according to the temperature as shown with the solid line. Also, $Y_1$ is a modifying portion for modifying the AVR output compensation amount when the degree of characteristic deterioration is changed from reversible to irreversible. It is for instance 2V in the example shown in FIG. 3 (Step S7).

In the case that it is judged in the step S6 that the drum temperature T is higher than $T_1$, it is judged in the following step S8 whether or not the drum temperature T is lower than $T_2$. The $T_2$ is another partitioning temperature which is higher than the $T_1$ and is 40° C. in the example in FIG. 3.

Here, in the case that the current drum temperature T is lower than the $T_2$, an operation of the AVR output compensation amount V(t)=Vo (t)+$Y_2$ is carried out (in the step S9).

The $Y_2$ is the modified amount of the AVR output compensation amount during the period while the drum temperature is between $T_1$ and $T_2$, and in t e example shown in FIG. 3, 1V corresponds to the modified amount thereof.

In addition, in the case that it is judged in the step S8 that the drum temperature T is further higher than the $T_2$, the processing in the step S10 is executed. In this embodiment, as shown in FIG. 3, as it is not necessary to modify the AVR output compensation amount by the amount to which the irreversible characteristic deterioration has occurred when the $T_2$ is over 40° C., the AVR output compensation amount V(t) is set to Vo(t) (i.e., AVR output compensation amount V(t)=Vo(t)).

As shown in the above, as the AVR output compensation amount (image density setting conditions) is set according to respective temperature levels in the steps S7, S9 and S10, the AVR output voltage is next compensated by the compensation amount V(t) set in the step S11, thereby causing the exposure lamp 3 to be driven on the basis of the voltage and the copying processing (Step S12) to be carried out. The control means in the invention is for realizing the processing from the step S6 through the step S12.

In this preferred embodiment, the drum temperature 4 is divided into three levels and the image density setting conditions are memorized to the three levels, respectively, thereby causing the image forming processing to be conducted by selectively applying these conditions. However, the escalation of the temperature range is not limited to the three levels as shown in the above. It can be set to two levels simply or can be set to four levels further in details.

In the above preferred embodiment, in the case that the drum temperature is higher than the T2, the same level as that for the state in which irreversible characteristic deterioration does not occur is adopted. However, it is needless to say that another proper characteristic is set according to the characteristic of the photosensitive body drum 4 and may be selected for application.

Furthermore, the invention is not limited to an organic photosensitive body but can apply to all the types of photosensitive bodies in which irreversible characteristic deterioration may occur.

What is claimed is:

1. An image processing equipment by which image density setting conditions are adjusted according to the temperature changes of an organic photosensitive body, said image processing equipment being characterized in that a number of times of using the image processing equipment under such a condition that a temperature of the organic photosensitive body has exceeded an appointed predetermined temperature is counted, and a relation of conditions of the image density to the temperature of the photosensitive body is adjusted according to the results of the counting thereof.

2. An image processing equipment, by which image density setting conditions are adjusted according to the temperature changes of an organic photosensitive body, comprising:

temperature detecting means for detecting a temperature of the organic photosensitive body;

irreversible characteristics deterioration detecting means for counting the number of times of using the image processing equipment under such a condition that an output value from the temperature detecting means exceeds an appointed predetermined temperature; and characteristics changing means for changing a relation of the image density conditions to the temperature of the photosensitive body according to results of the counting by the irreversible characteristics deterioration detecting means.

3. An image processing equipment for image forming, by which image density setting conditions are adjusted according to the temperature changes of an organic photosensitive body, comprising;

temperature detecting means for detecting a temperature of the organic photosensitive body;

condition memorizing means for memorizing escalation of the image density setting conditions according to the temperature of the photosensitive body;

irreversible characteristics deterioration detecting means for counting the number of times of using the image processing equipment under such a condition that an output value from the temperature detecting means exceeds an appointed predetermined temperature; and controlling means for processing the image forming by selectively adapting the image density setting conditions memorized in the condition memorizing means according to the temperature of the photosensitive body detected by the temperature detecting means when further characteristics deterioration of the photosensitive body than the appointed level is detected by the irreversible characteristics deterioration detecting means.

* * * * *